US008104394B2

(12) United States Patent
Meyers

(10) Patent No.: US 8,104,394 B2
(45) **Date of Patent: *Jan. 31, 2012**

(54) FLASH SUPPRESSOR APPARATUS AND METHODS

(75) Inventor: Brad E. Meyers, Issaquah, WA (US)

(73) Assignee: B. E. Meyers, Redmond, WA (US)

( * ) Notice: Subject to any disclaimer, the term of this patent is extended or adjusted under 35 U.S.C. 154(b) by 23 days.

This patent is subject to a terminal disclaimer.

(21) Appl. No.: 11/869,683

(22) Filed: Oct. 9, 2007

(65) Prior Publication Data

US 2009/0178549 A1 Jul. 16, 2009

Related U.S. Application Data

(62) Division of application No. 10/912,941, filed on Aug. 5, 2004, now Pat. No. 7,302,774, which is a division of application No. 10/179,330, filed on Jun. 24, 2002, now Pat. No. 6,837,139.

(51) Int. Cl.
*F41A 21/00* (2006.01)

(52) U.S. Cl. ..... 89/14.2; 42/77; 42/79; 89/14.3; 89/14.4

(58) Field of Classification Search ..... 89/14.2, 89/14.3, 14.4; 42/77, 79
See application file for complete search history.

(56) References Cited

U.S. PATENT DOCUMENTS 1,174,165 A * 3/1916 Kenney ..... 89/14.3
1,555,026 A 9/1925 Rose
1,598,360 A 8/1926 Pavek
2,466,104 A 4/1949 Hilburn
2,558,200 A * 6/1951 Schmeling ..... 42/79
2,602,255 A 7/1952 Cutts
2,662,326 A * 12/1953 Powell ..... 42/79
2,700,839 A 2/1955 Finlay et al.
2,765,706 A 10/1956 Strohl
2,780,962 A * 2/1957 Ressler et al. ..... 89/14.2
2,870,679 A 1/1959 Collins
2,883,781 A * 4/1959 Harvey ..... 42/105
2,900,875 A 8/1959 Fergus et al.
2,925,830 A 2/1960 Kantrowitz
3,455,203 A 7/1969 Pillersdorf (Continued)

OTHER PUBLICATIONS

Silencers, Patterns and Principles, Frankford Arsenal Report, R-1896, Aug. 1968, pp. 2-7.*

(Continued)

*Primary Examiner* — Michelle Clement
(74) *Attorney, Agent, or Firm* — McKenna Long & Aldridge LLP

(57) ABSTRACT

Flash suppressors having novel expansion features are disclosed. In one embodiment, a suppressor includes an attachment portion adapted to attach to a gun barrel, and a suppressor portion coupled to the attachment portion. The suppressor portion has a suppressor bore that is adapted to be aligned with a longitudinal axis of the gun barrel to allow a projectile from the gun barrel to pass therethrough. The suppressor bore is defined by at least one bore surface having at least one expansion groove disposed therein. The expansion groove may be partially-circumferentially disposed about the suppressor bore, or may include a plurality of expansion grooves. In another embodiment, a flash apparatus includes a suppressor portion having a plurality of longitudinally elongated members spaced apart about a circumference of the suppressor bore, each member being separated from adjacent elongated members by a longitudinal slot, at least one longitudinal slot having non-parallel sidewalls.

16 Claims, 4 Drawing Sheets

U.S. PATENT DOCUMENTS

| | | | | |
|---|---|---|---|---|
| 3,483,794 | A | 12/1969 | Packard | |
| 3,667,570 | A * | 6/1972 | WerBell, III | 181/223 |
| 3,676,947 | A | 7/1972 | Ashbrook et al. | |
| 3,714,864 | A | 2/1973 | Thierry | |
| 4,024,791 | A * | 5/1977 | Stratman | 89/14.2 |
| 4,176,487 | A * | 12/1979 | Manis | 42/76.01 |
| 4,374,484 | A * | 2/1983 | Bekker et al. | 89/14.3 |
| 4,570,529 | A | 2/1986 | A'Costa | |
| 4,588,043 | A | 5/1986 | Finn | |
| 4,664,014 | A | 5/1987 | Hawley et al. | |
| 4,893,544 | A | 1/1990 | Hawley et al. | |
| 4,920,854 | A | 5/1990 | Scanlon | |
| 5,005,463 | A | 4/1991 | A'Costa | |
| 5,092,223 | A * | 3/1992 | Hudson | 89/14.2 |
| 5,317,825 | A * | 6/1994 | Vatterott et al. | 42/79 |
| 5,361,677 | A | 11/1994 | Warner et al. | |
| 5,415,073 | A | 5/1995 | Ciluffo | |
| 5,433,133 | A | 7/1995 | La France | |
| 5,590,688 | A | 1/1997 | Pitkanen et al. | |
| 5,596,161 | A | 1/1997 | Sommers | |
| 5,773,746 | A * | 6/1998 | Vaden | 89/14.4 |
| 5,831,202 | A | 11/1998 | Rustick | |
| 5,883,328 | A | 3/1999 | A'Costa | |
| 6,298,764 | B1 | 10/2001 | Sherman et al. | |
| 6,308,609 | B1 | 10/2001 | Davies | |
| 6,425,310 | B1 * | 7/2002 | Champion | 89/14.3 |
| 6,578,462 | B1 * | 6/2003 | Franchino et al. | 89/14.3 |
| 6,595,099 | B1 | 7/2003 | Olson et al. | |
| 6,722,254 | B1 | 4/2004 | Davies | |
| 6,820,530 | B2 * | 11/2004 | Vais | 89/14.3 |
| 6,837,139 | B2 * | 1/2005 | Meyers | 89/14.2 |
| 7,328,645 | B1 * | 2/2008 | Curry et al. | 89/14.3 |
| 2003/0106416 | A1 * | 6/2003 | Vais | 89/14.3 |
| 2003/0106417 | A1 * | 6/2003 | Vais | 89/14.3 |
| 2003/0154849 | A1 * | 8/2003 | Breuer | 89/14.3 |
| 2004/0244571 | A1 * | 12/2004 | Bender | 89/14.3 |

OTHER PUBLICATIONS

Headquarters, U.S. Army Material Command, "Engineering Design Handbook: Guns Series; Muzzle Devices," AMC Pamphlet, Document No. AMCP 706-251, May 1968.

B.E. Meyers, promotional literature entitled "More on the . . . Crew Served Weapon Infrared Laser Illumination and Targeting System", Copyright 1998 B.E. Meyers Co, Inc., 1-2pg.

Smith, Photo of T65E3, from "Small Arms of the World", 10th Edition, copyright 1973, p. 685, LC72-90881 SBN8117-1566-3.

Gary W. Cooke, specification sheet for M85 .50 Caliber Fixed Machine Gun, from "Gary's Combat Vehicle Reference Guide", pp. 1-4, dated Dec. 1, 2004.

FAS Military Analysis Network, description of M85 .50 Caliber Machine Gun (3 pages total), dated Sep. 12, 1998.

Gary W. Cooke, exploded schematic diagram of M85 .50 Caliber Machine Gun, from "Gary's Combat Vehicle Reference Guide", one page, undated but printed on Feb. 21, 2008 from http://www.inetres.com/gp/military/cv/weapon/M85_3.gif.

STG '58 Austrian Flashhider, 3 photographs.

Prototype '57 Flashhider, 1 photograph.

Production Flashhider '61, 2 photographs.

Steyr AUG flash suppressor, 1977, 1 photograph.

Steyr AUG BFA's Blank Firing Attachments, 1 photograph.

* cited by examiner

FLASH SUPPRESSOR APPARATUS AND METHODS

CROSS REFERENCE TO RELATED APPLICATIONS

This patent application is a divisional application of co-pending, commonly-owned U.S. patent application Ser. No. 10/912,941 entitled "Flash Suppressor Apparatus and Methods" filed on Aug. 5, 2004, which is a divisional application of commonly-owned U.S. patent application Ser. No. 10/179,330 entitled "Flash Suppressor Apparatus and Methods" filed on Jun. 24, 2002 which issued as U.S. Pat. No. 6,837,139 on Jan. 4, 2005, which applications and issued patent are incorporated herein by reference.

FIELD OF THE INVENTION

The present invention is directed toward flash suppressors, and more specifically, to flash suppressors having novel expansion features.

BACKGROUND OF THE INVENTION

The eruption of hot, high pressure gases from a gun barrel when a gun is fired is commonly referred to as muzzle blast. Muzzle blast is typically composed of an inner core of hot gases and partially burned particulate matter (e.g. unburned powder) emanating along a longitudinal axis extending out from the muzzle of the gun barrel. As a projectile exits from the muzzle, the hot gases rapidly expand outwardly into the surrounding air, mixing with the surrounding air and forming an oblique shock structure known as a "shock bottle." The unburned particulate may ignite upon mixing with the oxygen-rich surrounding air. The result is that the inner core of hot gases and the burning particulate within the shock bottle produces a bright flash of light in both the visible and infrared portions of the spectrum.

In battle, muzzle blast may have serious adverse consequences. It is known that muzzle blast may be used by friend and foe alike to locate the position of a concealed soldier, artillery piece, or other gun emplacement, particularly during night operations. It is also known that for certain sighting systems, muzzle blast from a gun may adversely impact the gun's own sighting system. For these and other reasons, the desire to suppress the bright flash associated with muzzle blast has long been known, and a variety of suppressor devices have been developed for this purpose, including, for example, the flash suppressors disclosed in U.S. Pat. No. 5,883,328 issued to A'Costa, U.S. Pat. No. 6,298,764 issued to Sherman et al., U.S. Pat. No. 6,308,609 issued to Davies, and U.S. Pat. No. 5,596,161 issued to Sommers.

Although some success has been achieved using prior art suppressor devices, there is room for improvement. For example, some conventional devices are not fully effective suppressors and only partially attenuate the bright flash associated with muzzle blast. Other devices may initially perform satisfactorily, but tend to loose their effectiveness as multiple rounds are fired from the gun, such as for a machine gun. Therefore, a continuing need exists for an improved flash suppressor.

SUMMARY OF THE INVENTION

The present invention is directed to flash suppressors having novel expansion features. In one embodiment, a suppressor apparatus adapted for use on a gun barrel includes an attachment portion adapted to attach to the gun barrel, and a suppressor portion coupled to the attachment portion. The suppressor portion has a suppressor bore therethrough that is adapted to be aligned with a longitudinal axis of the gun barrel to allow a projectile from the gun barrel to pass therethrough. The suppressor bore is defined by at least one bore surface having at least one expansion groove disposed therein. In a further embodiment, the at least one expansion groove is at least partially circumferentially disposed about the suppressor bore. In another embodiment, the at least one expansion groove is a plurality of circumferential expansion grooves disposed in the bore surface.

In another embodiment, a flash apparatus includes an attachment portion adapted to attach to the gun barrel, and a suppressor portion coupled to the attachment portion and having a suppressor bore therethrough. The suppressor portion includes a plurality of longitudinally elongated members spaced apart about a circumference of the suppressor bore, each elongated member being separated from adjacent elongated members by a longitudinal slot and having an inner surface partially defining the suppressor bore. At least one longitudinal slot has first and second longitudinal sidewalls, the first and second longitudinal sidewalls being non-parallel. Alternately, the first and second sidewalls include first and second inner edges proximate the suppressor bore and first and second outer edges distal from the suppressor bore, respectively, the first and second outer edges being spaced apart by a greater distance than the first and second inner edges.

BRIEF DESCRIPTION OF THE DRAWINGS

Embodiments of the present invention are described in detail below with reference to the following drawings.

DETAILED DESCRIPTION

The present disclosure is directed toward flash suppressor apparatus and methods, and more specifically, to flash suppressors having novel expansion features. Many specific details of certain embodiments in accordance with the present disclosure are set forth in the following description and in FIGS. 1-7 to provide a thorough understanding of such embodiments. One skilled in the art, however, will understand that the present invention may have additional embodiments, or that the invention may be practiced without several of the details described in the following description.

Figure 1:
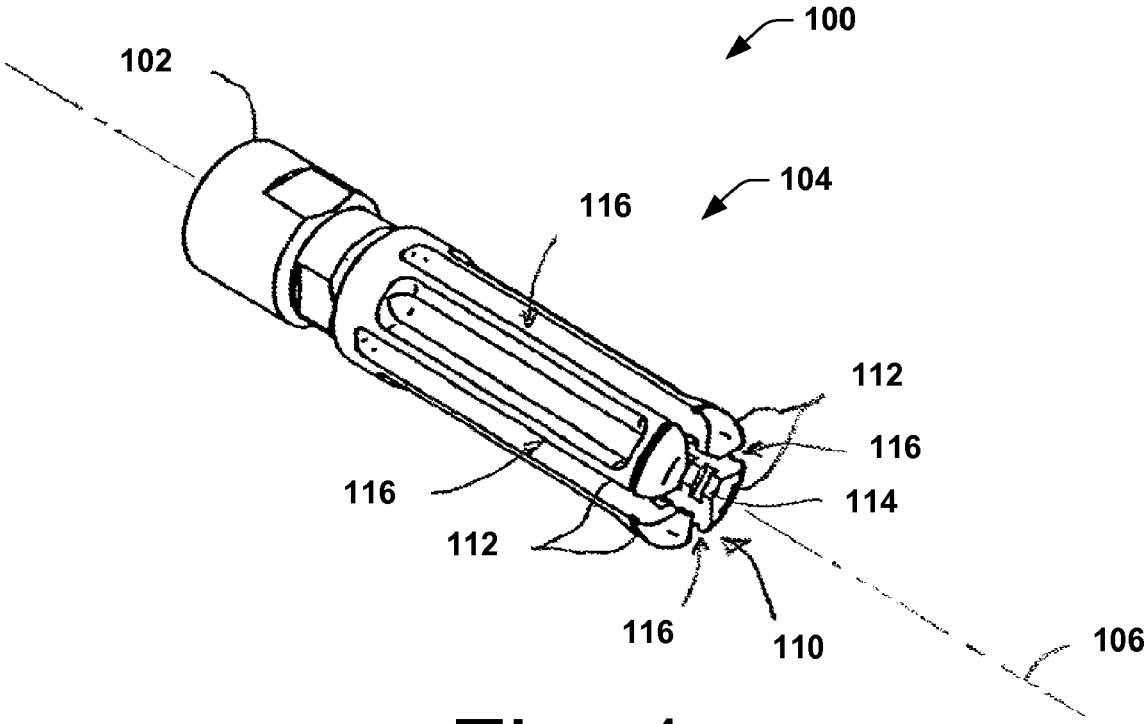
FIG. 1 is a front isometric view of a suppressor in accordance with an embodiment of the invention.
Figure 2:
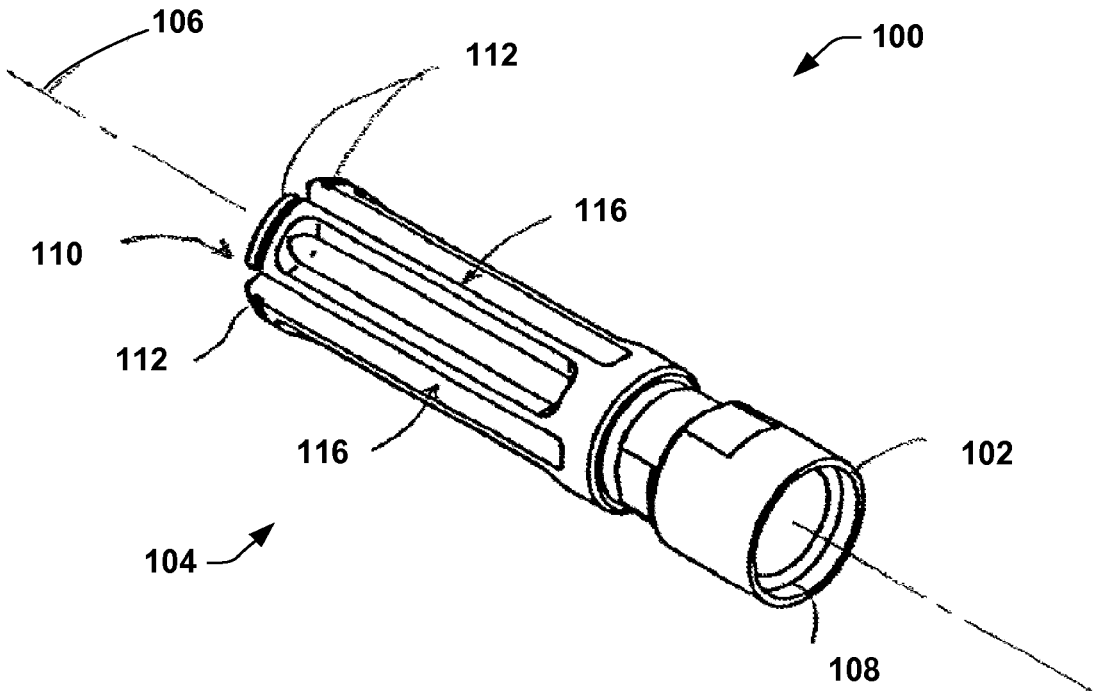
FIG. 2 is a rear isometric view of the suppressor of FIG. 1.

FIG. 1 is a front isometric view of a suppressor 100 in accordance with an embodiment of the invention. FIG. 2 is a rear isometric view of the suppressor 100 of FIG. 1. In the embodiment shown in FIGS. 1 and 2, the suppressor 100 includes an attachment portion 102 that is adapted to attach to a muzzle of a gun barrel (not shown), and a suppressor portion 104 that extends outwardly beyond the end of the gun barrel along a longitudinal axis 106.

The suppressor portion 104 has a suppressor bore 110 disposed therethrough that extends along the longitudinal axis 106. A plurality of prongs (or elongated members) 112 are distributed circumferentially about the suppressor bore 110. Each prong 112 includes an inner surface 114 (FIG. 1) that is proximate to, and at least partially defines, the suppressor bore 110. Each prong 112 is also separated from adjacent prongs 112 by slots 116. In the embodiment shown in FIGS. 1 and 2, the suppressor portion 104 includes four prongs 112 and four slots 116, although a greater or lesser number of prongs 112 or slots 116 may be employed.

In this embodiment of the suppressor 100, the attachment portion 102 includes an internal thread 108 that threadedly engages a corresponding thread on the end of the gun barrel (not shown). In alternate embodiments, however, the attachment portion 102 may be attached to the gun barrel by any suitable means, including clamps, quick-release connectors, welding, or other known attachment devices, or may even be integrally formed with the gun barrel.

Figure 3:
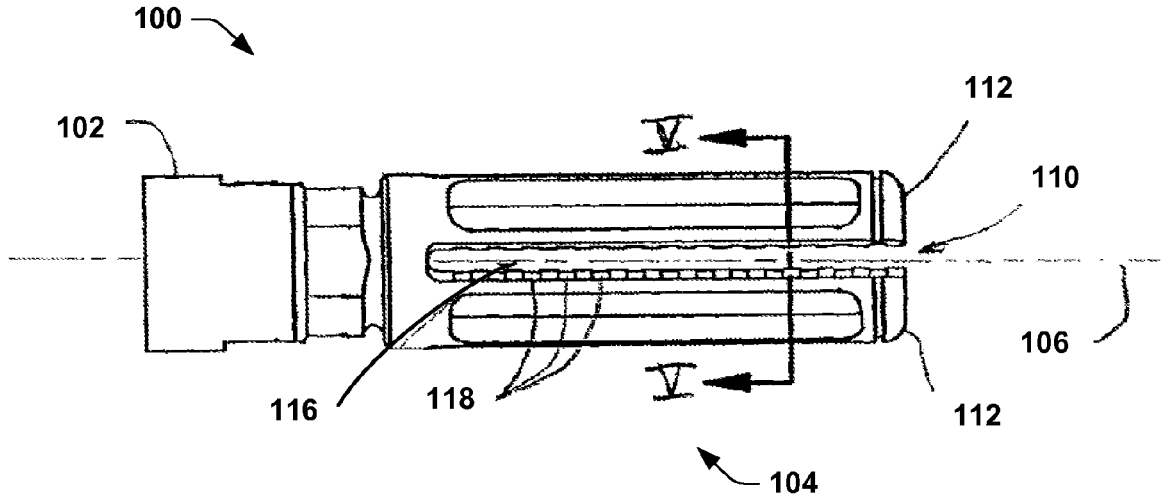
FIG. 3 is a side elevational view of the suppressor of FIG. 1.
Figure 4:
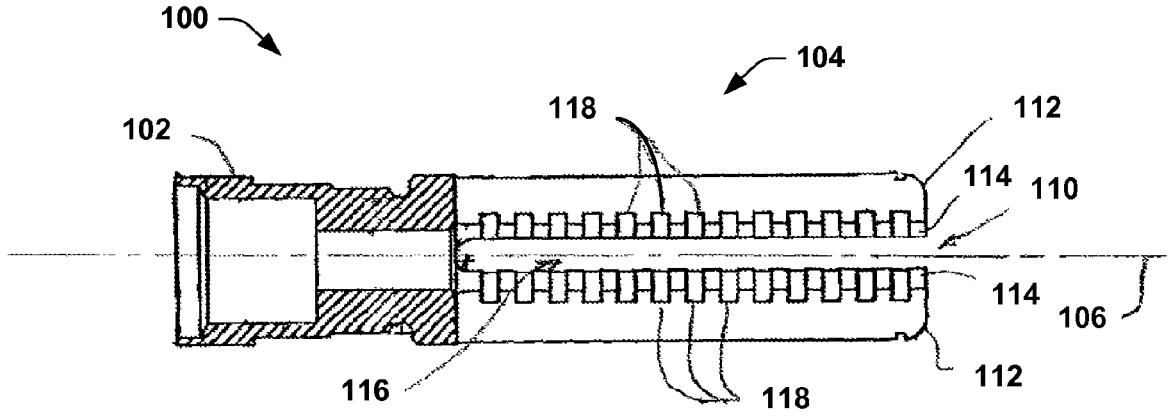
FIG. 4 is a side cross-sectional view of the suppressor of FIG. 1.

FIGS. 3 and 4 show additional aspects of the inventive apparatus. FIGS. 3 and 4 are side elevational and side cross-sectional views, respectively, of the suppressor 100 of FIG. 1. As best shown in FIG. 4, the inner surface 114 of each prong 112 has a plurality of grooves 118 disposed therein that partially-circumferentially extend about the suppressor bore 110.

In operation, the suppressor 100 is attached to the muzzle of the gun barrel with the suppressor bore 110 aligned with the axis of the gun barrel. When the gun is fired, a projectile (not shown) exiting the muzzle travels along the longitudinal axis 106 through the suppressor bore 110. Following the projectile, the hot, high pressure gases of the muzzle blast enter the suppressor bore 110. A first portion of the muzzle blast expands into the plurality of grooves 118, wherein the hot gases of the first portion are cooled by expansion and also by heat transfer into the inner surfaces 114, including the surfaces of the grooves 118. After expanding into the grooves 118, the first portion of the muzzle blast may continue to expand outwardly through the slots 116 and into the surrounding ambient air. A second portion of the muzzle blast expands directly outwardly from the suppressor bore 110 into the ambient air through the plurality of slots 116.

The inventive suppressor 100 advantageously provides improved suppression of the flash associated with muzzle blast. Because the inner surfaces 114 surrounding the suppressor bore 110 have grooves 118, at least a portion of the hot, high pressure gases of the muzzle blast is expanded into the grooves 118. This portion of the gas is cooled by the expansion into the grooves 118 prior to exiting through the slots 116. The grooves 118 also increase the surface area of the inner surfaces 114 defining the suppressor bore 110, which may further improve the cooling of the muzzle blast gases by increasing the surface area for convective heat transfer from the hot gases into the suppressor 100. Thus, at least part of the gases from the muzzle blast are expanded and cooled within the suppressor portion 104 prior to exiting into the surrounding ambient air. The result is that the inventive suppressor reduces the flash associated with muzzle blast in both the visible and infrared portions of the spectrum.

Another aspect of the inventive suppressor 100 is that the grooves 118 may capture unburned and partially-burned particulates in the muzzle blast and provide hidden, protected areas for these particulates to burn when exposed to oxygen from the surrounding air. Because the particulates may finish burning within the grooves, the light emitted by the burning particulates is at least partially shielded and prevented from escaping into the surrounding air. Thus, this additional aspect of the inventive suppressor may further reduce the optical signature of the muzzle blast.

It should be noted that a variety of alternate embodiments may be readily conceived in accordance with the teachings of this disclosure, and that the invention is not limited to the particular embodiment shown in FIGS. 1 through 4. For example, although the grooves 118 are shown in FIGS. 3 and 4 as being uniformly spaced along the inner surfaces 114 of the prongs 112, they may be non-uniformly spaced in any desired pattern or arrangement. Furthermore, although the grooves 118 are depicted as being circumferential grooves, any other type of groove may be used, including, for example, spiral, helical, or any other circumferentially or non-circumferentially-disposed grooves (e.g. longitudinal grooves or cross-hatching grooves). In addition, the physical dimensions of the grooves may be varied from those dimensions shown in the accompanying figures, and the grooves need not be uniformly dimensioned, but may vary in depth, width, angle, or any other design characteristic according to any desired pattern or arrangement.

Figure 5:
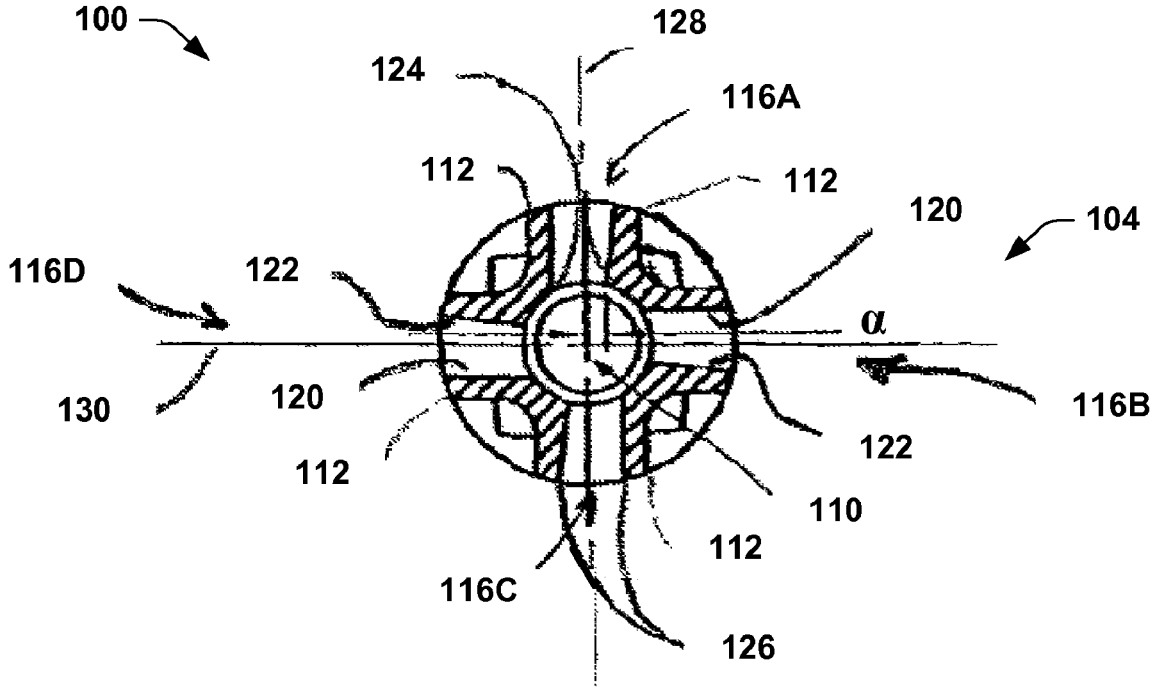
FIG. 5 is an end cross-sectional view of the suppressor of FIG. 1.

Additional aspects of the invention are shown in FIG. 5. FIG. 5 is an end cross-sectional view taken along the line V-V of FIG. 3. As shown in FIG. 5, the slots 116 extend from the suppressor bore 110 outwardly to an outer periphery of the suppressor portion 104. Each slot 116 has first and second sidewalls 120, 122 that are non-parallel. Specifically, each first and second sidewall 120, 122 has an inner edge 124 proximate to the suppressor bore 110, and an outer edge 126 proximate to the periphery of the suppressor portion 104, and the outer edges 126 of the first and second sidewalls 120, 122 are spaced apart by a greater distance than the inner edges 124.

With the suppressor 100 oriented as shown in FIG. 5, the first sidewalls 120 of the first and third slots 116A, 116C are parallel with a vertical axis 128, and the first sidewall 120 of the second and fourth slots 116B, 116D are parallel with a horizontal axis 130. Each of the second sidewalls 122, however, is positioned at an angle $\alpha$ with respect to each corresponding first sidewall 120. In the embodiment shown in FIG. 5, the angle $\alpha$ is approximately seven degrees.

In operation, as the hot, high pressure gases of the muzzle blast enter the suppressor bore 110, they begin to expand outwardly through the slots 126. Because the slots 116 having diverging sidewalls 120, 122, each slot 116 may permit the muzzle blast gases to expand more fully before reaching the surrounding ambient air. In this way the suppressor portion 104, further reduces the flash from the muzzle blast.

Figure 6:
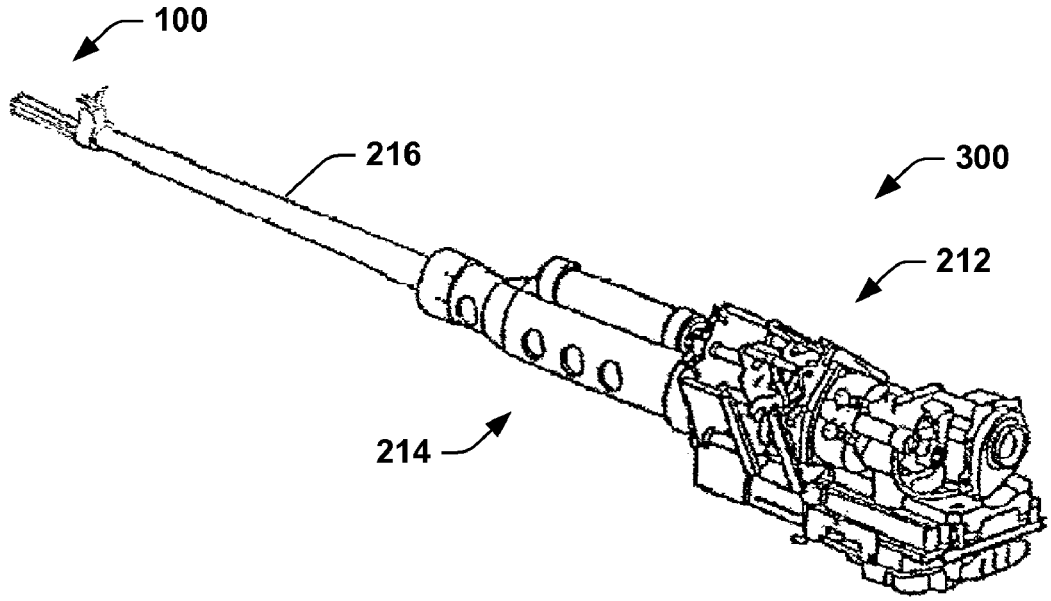
FIG. 6 is a rear isometric view of a gun assembly in accordance with an embodiment of the invention.

FIG. 6 is a rear isometric view of a gun assembly 200 in accordance with an embodiment of the invention. In this embodiment, the gun assembly 200 includes a gun 210 having a feeder assembly 212, a receiver assembly 214, and a barrel 216. A flash suppressor 100 is attached to the barrel 216. The feeder assembly 212 transfers ammunition (not shown) into the receiver assembly 214, and removes and ejects spent casings from the receiver assembly 214. The receiver assembly 214 receives the ammunition, secures and aligns it in the proper position, and fires the ammunition through the barrel 216. Although the gun 210 shown in FIG. 6 may be virtually any type of gun, in one embodiment, the gun 210 represents the M242 machine gun which is presently used on the U.S. Army's Bradley Fighting Vehicle and the U.S. Marine's Light Armored Vehicle. In alternate embodiments, the gun 210 may be, for example, the MK 16 machine gun or the M240 machine gun.

Figure 7:
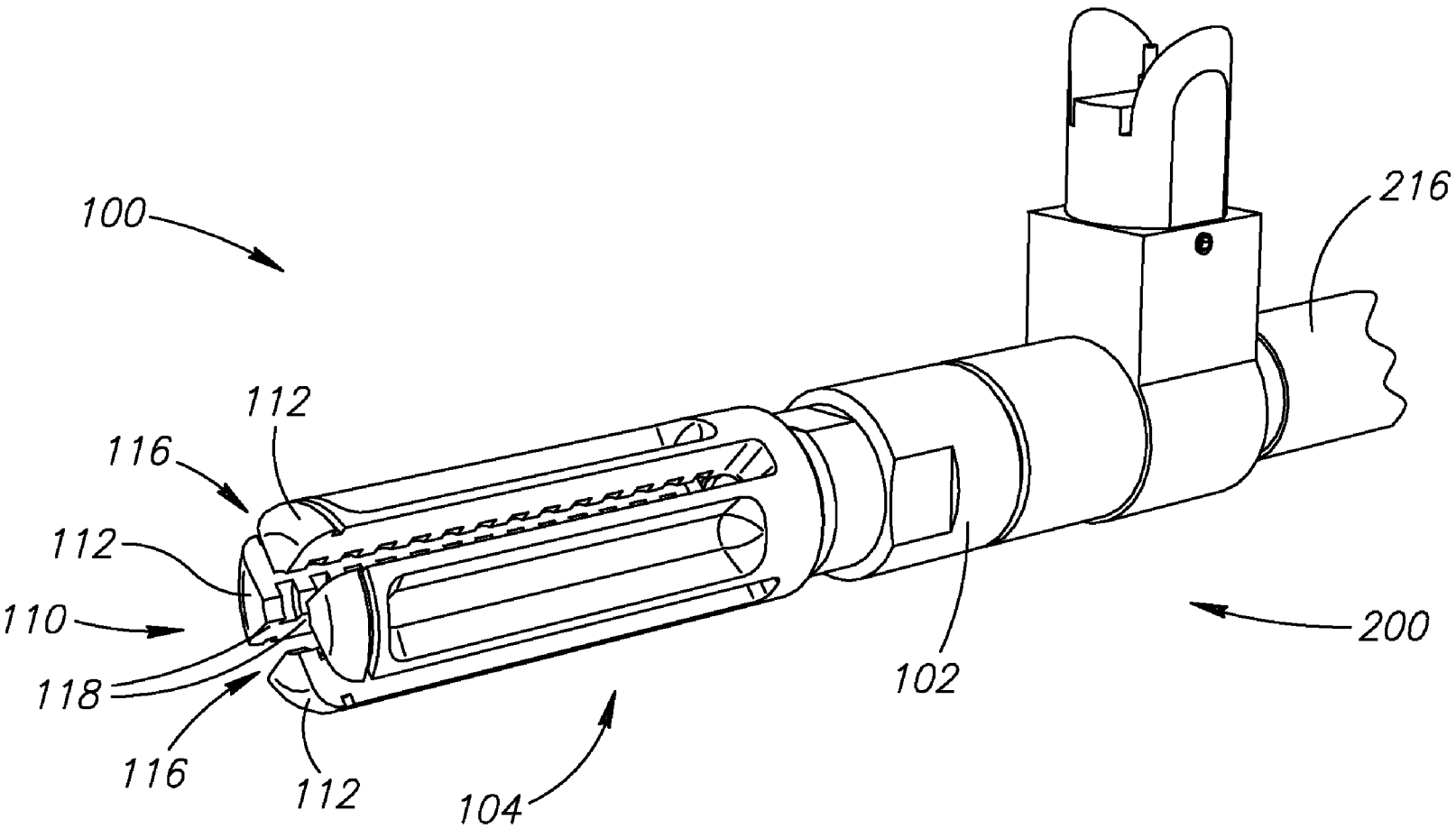
FIG. 7 is an enlarged partial isometric view of the gun assembly of FIG. 6.

FIG. 7 is an enlarged partial isometric view of the flash suppressor 100 of the gun assembly 200 of FIG. 6. The components of the flash suppressor 100 were described in detail above, and for the sake of brevity, will not be repeated. As shown in FIG. 7, the attachment portion 102 is attached to the barrel 216 and the suppressor portion 104 extends beyond the end of the barrel 216 with the suppressor bore 110 aligned with the barrel 216. The prongs 112 partially surround the suppressor bore 110 and are separated by the elongated slots 116. The inner surfaces 114 of the prongs 112 includes the plurality of expansion grooves 118 that increase the expansion of the muzzle blast gases in the manner described above.

Tests of gun assemblies of the type shown in FIGS. 6 and 7 have shown that the gun assembly 200 equipped with the inventive flash suppressor 100 provides vastly improved flash-suppression performance in comparison with prior art assemblies. The above-described inventive aspects of the suppressor 100 advantageously enable the suppressor 100 to maintain its suppression performance during tests using machine guns firing large numbers of rounds. While some prior art devices are capable of flash suppression for one or a couple of shots before suffering a degradation of performance, the inventive suppressor 100 has been demonstrated to provide superior performance for large numbers of shots as commonly occurs when machine guns are used in battle. Thus, the inventive suppressor 100 provides the needed flash-suppressing performance over a range of conditions that are more typical of actual battle conditions than prior art devices.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other flash suppressor apparatus and methods having novel expansion features, and not just to the embodiments described above and shown in the accompanying figures. Accordingly, the scope of the invention should be determined from the following claims.

What is claimed is:

1. A method of suppressing a muzzle blast from an end of a gun barrel, comprising:

providing a suppressor device attached to the end of the gun barrel, the suppressor device having a suppressor bore aligned with a longitudinal axis of the gun barrel and a plurality of longitudinally extending prongs disposed about the suppressor bore, each prong having an inner surface proximate the suppressor bore and being spaced apart from adjacent prongs by longitudinally extending slots;

generating the muzzle blast from the end of the gun barrel;

at least partially receiving the muzzle blast from the end of the gun barrel into the suppressor bore;

expanding at least a portion of the muzzle blast into at least one circumferentially-extending expansion groove disposed within one or more of the inner surfaces of the plurality of longitudinally extending prongs disposed about the suppressor bore; and expanding at least a portion of the groove-expanded gas through at least one longitudinally-extending slot disposed to receive the at least a portion of the groove-expanded gas directly from an end of the at least one circumferentially-extending expansion groove, the at least one longitudinally-extending slot having first and second non-parallel longitudinal sidewalls;

wherein the at least one circumferentially-extending expansion groove and the at least one longitudinally-extending slot having first and second non-parallel longitudinal sidewalls reduce the flash due to the muzzle blast.

2. The method of claim 1 wherein expanding at least a portion of the muzzle blast into at least one circumferentially-extending expansion groove comprises expanding at least a portion of the muzzle blast into at least one circumferentially-extending expansion groove at least partially-circumferentially disposed about the suppressor bore.

3. The method of claim 1 wherein expanding at least a portion of the muzzle blast into at least one circumferentially-extending expansion groove comprises expanding at least a portion of the muzzle blast into a plurality of uniformly-spaced circumferentially-extending expansion grooves, each expansion groove having a rectangular cross-sectional shape.

4. The method of claim 1, further comprising, simultaneously with expanding at least a portion of the muzzle blast into at least one circumferentially-extending expansion groove disposed within a surface at least partially defining the suppressor bore, expanding at least a second portion of the muzzle blast through a longitudinally-extending slot disposed through the suppressor device to the suppressor bore.

5. The method of claim 4 wherein expanding at least a second portion of the muzzle blast through a longitudinally-extending slot comprises expanding at least a second portion of the muzzle blast through a longitudinally-extending slot having first and second non-parallel longitudinal sidewalls.

6. The method of claim 4 wherein expanding at least a second portion of the muzzle blast through a longitudinally-extending slot comprises expanding at least a second portion of the muzzle blast through a longitudinally-extending slot having first and second longitudinal sidewalls having first and second inner edges proximate the suppressor bore, respectively, and first and second outer edges distal from the suppressor bore, respectively, the first and second outer edges being spaced apart by a greater distance than the first and second inner edges.

7. The method of claim 4 wherein expanding at least a second portion of the muzzle blast through a longitudinally-extending slot comprises expanding at least a second portion of the muzzle blast through a longitudinally-extending slot having first and second longitudinal sidewalls wherein a first plane that includes the first sidewall and a second plane that includes the second sidewall form a divergence angle of about seven degrees.

8. A method of suppressing a muzzle blast from an end of a gun barrel, comprising:

providing a suppressor device attached to the end of the gun barrel, the suppressor device having a suppressor bore aligned with a longitudinal axis of the gun barrel and a plurality of longitudinally extending members disposed about the suppressor bore, each member having an inner surface proximate the suppressor bore and being spaced apart from adjacent members by longitudinally extending slots;

generating the muzzle blast from the end of the gun barrel; at least partially receiving the muzzle blast from the end of the gun barrel into the suppressor bore;

expanding at least a portion of the muzzle blast into at least one circumferentially-extending expansion groove disposed within one or more of the inner surfaces of the plurality of longitudinally extending members disposed about the suppressor bore, the expansion groove having ends disposed to openly communicate with one or more longitudinally-extending slots disposed through the suppressor device to the suppressor bore; and expanding at least a portion of the muzzle blast expanded by the at least one circumferentially-extending expansion groove through the one or more longitudinally-extending slots, at least one longitudinally-extending slot having first and second non-parallel longitudinal sidewalls, wherein the at least one circumferentially-extending expansion groove and the at least one longitudinally-extending slot having first and second non-parallel longitudinal sidewalls reduce the flash due to the muzzle blast.

9. The method of claim 8 wherein expanding at least a portion of the muzzle blast expanded by the at least one circumferentially-extending expansion groove through the one or more longitudinally-extending slots comprises radially expanding at least a portion of the muzzle blast expanded by the at least one circumferentially-extending expansion groove through the one or more longitudinally-extending slots.

10. The method of claim 8 wherein expanding at least a portion of the muzzle blast expanded by the at least one circumferentially-extending expansion groove through the one or more longitudinally-extending slots comprises expanding at least a portion of the muzzle blast expanded by the at least one circumferentially-extending expansion groove through at least one longitudinally-extending slot having first and second longitudinal sidewalls having first and second inner edges proximate the suppressor bore, respectively, and first and second outer edges distal from the suppressor bore, respectively, the first and second outer edges being spaced apart by a greater distance than the first and second inner edges.

11. The method of claim 8 wherein expanding at least a portion of the muzzle blast expanded by the at least one circumferentially-extending expansion groove through the one or more longitudinally-extending slots comprises expanding at least a portion of the muzzle blast expanded by the at least one circumferentially-extending expansion groove through at least one longitudinally-extending slot having first and second longitudinal sidewalls wherein a first plane that includes the first sidewall and a second plane that includes the second sidewall form a divergence angle of about seven degrees.

12. The method of claim 8, wherein expanding at least a portion of the muzzle blast into at least one circumferentially-extending expansion groove disposed within a surface at least partially defining the suppressor bore comprises expanding at least a portion of the muzzle blast into at least one at least one circumferentially extending expansion groove having a rectangular cross-sectional shape disposed within a surface at least partially defining the suppressor bore.

13. The method of claim 8 wherein expanding at least a portion of the muzzle blast into at least one circumferentially-extending expansion groove comprises expanding at least a portion of the muzzle blast into a plurality of circumferentially-extending expansion grooves disposed within a surface at least partially defining the suppressor bore, each expansion groove being at least partially-circumferentially disposed about the suppressor bore and having a rectangular cross-sectional shape.

14. The method of claim 13 wherein expanding at least a portion of the muzzle blast into at least one circumferentially extending expansion groove comprises expanding at least a portion of the muzzle blast into a plurality of circumferentially extending, substantially parallel expansion grooves.

15. A method of making a flash suppressor, the method comprising:

providing a suppressor configured to attach to the end of a gun barrel, the suppressor having a suppressor bore configured to align with a bore of the gun barrel and a longitudinal axis of the gun barrel;

configuring the suppressor such that it comprises two or more longitudinally extending prongs disposed about the suppressor bore, wherein each longitudinally extending prong is spaced apart from an adjacent prong by a longitudinally extending slot; and configuring each prong to include an inner surface proximate the suppressor bore, a first and a second non-parallel longitudinal sidewall, and one or more expansion grooves disposed about and circumferentially extending along one or more of the inner surfaces of the longitudinally extending prongs, such that the non-parallel longitudinal sidewalls and the one or more circumferentially-extending expansion grooves are configured to suppress a flash due muzzle blast.

16. A flash suppressor made in accordance with the method of claim 15.

* * * * *